US010205294B2

(12) United States Patent
Bröker et al.

(10) Patent No.: US 10,205,294 B2
(45) Date of Patent: Feb. 12, 2019

(54) HAND-ACTUATABLE CRIMPING TOOL

(71) Applicant: Weidmüller Interface GmbH & Co. KG, Detmold (DE)

(72) Inventors: Thilo Bröker, Detmold (DE); Christoph Dierks, Detmold (DE)

(73) Assignee: Weidmüller Interface GmbH & Co. KG (DE)

( * ) Notice: Subject to any disclaimer, the term of this patent is extended or adjusted under 35 U.S.C. 154(b) by 0 days.

(21) Appl. No.: 15/522,983

(22) PCT Filed: Nov. 19, 2015

(86) PCT No.: PCT/EP2015/077109
§ 371 (c)(1),
(2) Date: Apr. 28, 2017

(87) PCT Pub. No.: WO2016/079242
PCT Pub. Date: May 26, 2016

(65) Prior Publication Data

US 2017/0317460 A1 Nov. 2, 2017

(30) Foreign Application Priority Data

Nov. 19, 2014 (DE) ..... 20 2014 105 571 U

(51) Int. Cl.
*H01R 43/042* (2006.01)

(52) U.S. Cl.
CPC ..... *H01R 43/0421* (2013.01)

(58) Field of Classification Search
CPC ..... B25B 27/10; B25B 27/146; B25B 7/22; H01R 43/042; H01R 43/0421
See application file for complete search history.

(56) References Cited

U.S. PATENT DOCUMENTS

| | | | | |
|---|---|---|---|---|
| 3,903,725 | A | 9/1975 | Rommel | |
| 8,079,242 | B2 * | 12/2011 | Pacaud | B25B 27/10 72/21.1 |
| 8,407,885 | B2 | 4/2013 | Dierks et al. | |
| 9,410,875 | B2 | 8/2016 | Wagner et al. | |
| 2010/0293720 | A1 | 11/2010 | Zhang | |
| 2010/0313402 | A1 * | 12/2010 | Dierks | B25B 27/10 29/283.5 |

(Continued)

FOREIGN PATENT DOCUMENTS

| | | | |
|---|---|---|---|
| CN | 201052561 | Y | 4/2008 |
| DE | 2316769 | A1 | 10/1974 |

(Continued)

OTHER PUBLICATIONS

Machine Translation from EPO for DE 29806179 U1, Jun. 2018.*

*Primary Examiner* — Pradeep C Battula
(74) *Attorney, Agent, or Firm* — Laubscher & Laubscher, P.C.

(57) ABSTRACT

A hand-actuated crimping tool for manipulating electrical cables includes a pair of crimping grips which are pivotally connected for movement between open and closed positions and a crimping head for gripping a cable. An electronic counter including an electronic circuit and a signaling device is connected with one of the grips and is operable to count each time the crimping tool is operated.

10 Claims, 6 Drawing Sheets

(56) References Cited

U.S. PATENT DOCUMENTS

| | | | | |
|---|---|---|---|---|
| 2011/0252633 | A1* | 10/2011 | Dierks | G02B 6/3807 29/705 |
| 2013/0233043 | A1 | 9/2013 | Kelly | |
| 2016/0078338 | A1 | 3/2016 | Glockseisen | |

FOREIGN PATENT DOCUMENTS

| | | | | |
|---|---|---|---|---|
| DE | 29806179 | U1 * | 10/1998 | B25B 7/00 |
| DE | 202010005761 | U1 | 9/2011 | |
| DE | 102011050718 | A1 | 12/2012 | |
| EP | 2378332 | A2 | 10/2011 | |
| EP | 2995424 | A1 | 3/2016 | |
| FR | 2720177 | A1 | 11/1995 | |
| GB | 124875 | | 4/1919 | |

* cited by examiner

HAND-ACTUATABLE CRIMPING TOOL

This application is a § 371 national phase entry of PCT International Application No. PCT/EP2015/077109 filed Nov. 19, 2015. PCT/EP2015/077109 claims priority to DE Application No. 202014105571.1 filed Nov. 19, 2014. The entire content of these applications is incorporated herein by reference.

BACKGROUND OF THE INVENTION

The present invention relates to hand-actuatable crimping tool, in particular for processing cables.

It is known in generic crimping tools to provide an electronic counter which counts the number of activations performed with the crimping tool. This electronic counter is integrated in an auxiliary device which can be inserted into the crimping jaw of the crimping tool and which is removed from the crimping jaw when not being used.

The present invention was developed to provide a crimping tool with which the number of activations is made directly possible without using such an auxiliary counter device.

SUMMARY OF THE INVENTION

In the crimping tool according to the invention, a crimping head is provided for working or processing an object, in particular a cable and includes two crimping grips which pivot relative to one another between an open position and a closed position. An electronic counter with which the number of actuations can be counted and/or stored is secured in a first one of the crimping grips.

The counter includes an electronic circuit and a signaling device electrically connected with the electronic circuit.

In the closed position of the crimping grips, the second one of the crimping grips cooperates with the signaling device of the counter in such a manner that a counting signal is emitted by the signaling device to the electronic circuit.

The counter is secured in one of the grips of the crimping tool. Furthermore, this simplifies insertion and/or replacement of associated parts, for example different crimping molds on the crimping head of a crimping tool constructed as crimping pliers.

According to an embodiment of the invention, at least the crimping grip in which the counter is secured includes a hand lever and a grip shell at least partially surrounding the hand lever.

Both crimping grips are especially preferably designed in this manner. Therefore, the grip shell also serves as a protective jacket for the counter.

The counter is secured in a hollow space of the hand lever. As a consequence, a simple retrofitting of a crimping tool is also made possible with such a counter.

The counter and the signaling device can have different constructions.

Thus, the signaling device includes a piezo element electrically connected to the electronic circuit and an activator unit which can be moved by the second one of the crimping grips, exerting a mechanical force on the piezo element.

The use of such a piezo element has the particular advantage that no external energy source must be integrated into the crimping grip since the necessary energy for the electronic circuit and a signal display by the hand of the user who moves the crimping grips into their closed position is obtained by the exertion of pressure on the piezo element.

The activator unit includes a tilting lever which is pivotably supported in the first crimping grip in such a manner that it exerts a mechanical force on the piezo element in the closed position of the crimping grips.

The tilting lever is coupled with a multi-edged element, in particular a hexagon, via a translation element, wherein the multi-edged element exerts a mechanical force on the piezo element in the closed position of the crimping grips.

According to an alternative embodiment, the activator unit is constructed as a pressure switch movably supported in a linear manner on the first one of the crimping grips, wherein a pressure element of the pressure switch exerts a mechanical force on the piezo element in the closed position of the crimping grips. The activator unit constructed as a pressure switch can be built into the crimping grip in a simple and economical manner.

In another embodiment, the signaling device includes a magnet-sensitive electrical switch, wherein a magnet which activates the electrical switch in the closed position of the crimping grips is arranged in the second one of the crimping grips. Such a signaling device can also be readily built into the crimping grips for reliable use.

The electronic circuit preferably includes one or more output devices for information, especially one or more display devices, for example one or more LEDs.

According to an especially preferred embodiment, the electronic circuit is designed in such a manner as to add the signals produced by the movement of the crimping grips into its closed position, to compare them with one or more limit values and to emit a signal by the outputting device as a function of the result of this comparison.

On the one hand, this makes it possible to indicate only the readiness for the operation of the crimping tool, for example by a green LED as long as the number of the activating procedures performed which corresponds to the number of the closing movements of the crimping grips does not exceed a previously adjusted limit value. As soon as this limit value has been exceeded, for example, a red LED will light up which indicates that the crimping tool is in maintenance, must be checked and/or adjusted or that the service life of the crimping tool has been reached.

It is also possible to design the output device as a display with which numbers or other characters can be indicated so that information about the number of the activation process being carried out can also be indicated to the user.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
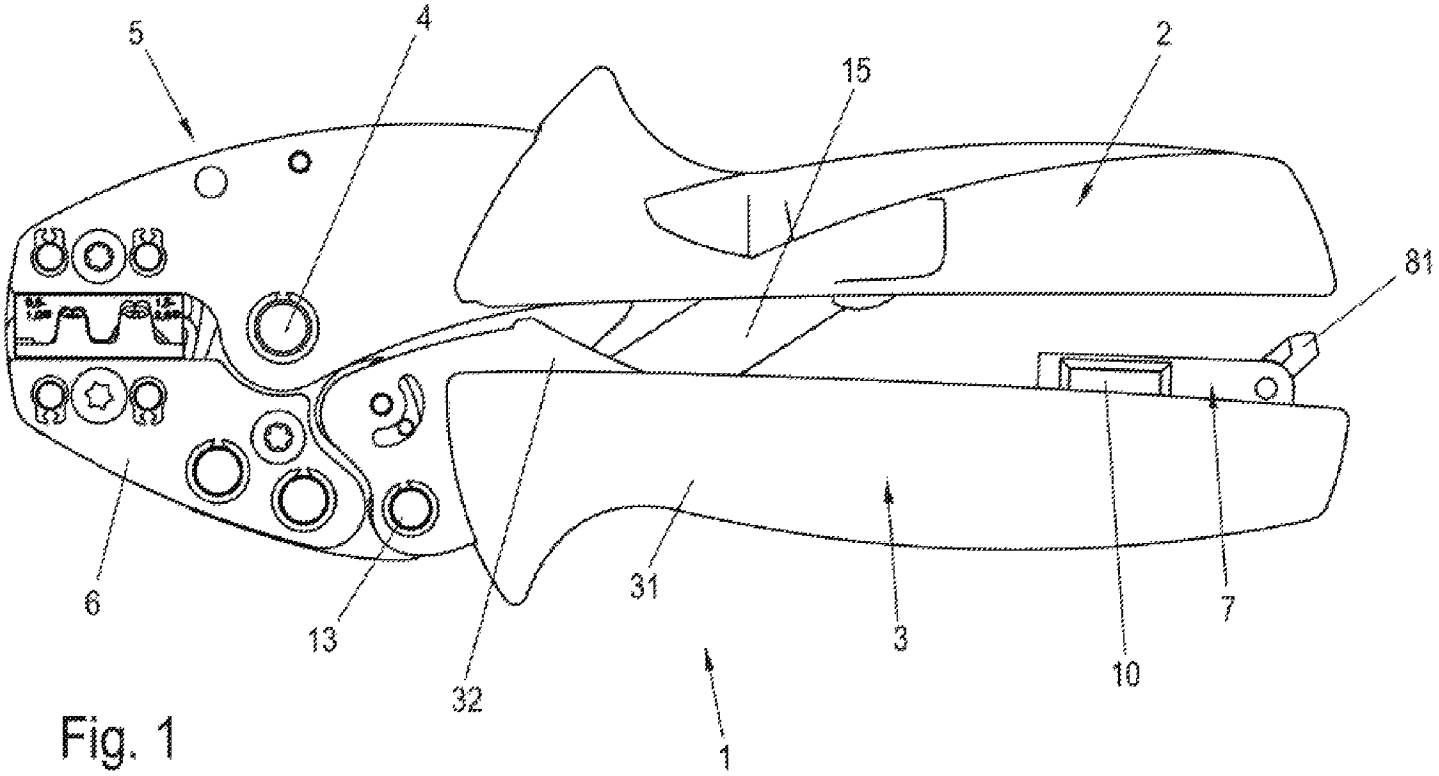
FIG. 1 is a side view of a first embodiment of a crimping tool according to the invention with an activator unit including a tilting lever.

In the following description of the drawing figures, concepts such as above, below, left, right, front, rear, etc. refer exclusively to the exemplary view and position of the crimping tool, of the crimping grips, of the counter, of the signaling device and the like selected in the figures. These concepts are not to be understood as limiting, that is, these references can change due to different work positions or to the mirror-symmetrical design or the like.

In FIGS. 1 to 6, the reference number 1 designates a hand-actuatable crimping tool. All embodiments have the basic construction of such a crimping tool with two crimping grips 2, 3 and a crimping head 5 for working on or processing a device such as a cable or an electrical line. The crimping grips 2, 3 can pivot relative to one another.

The crimping tool 1 is designed as crimping pliers for crimping a cable or a line. It is also conceivable to design the crimping tool as a stripping or cutting tool for removing insulation or the like from a wire or cable.

When the crimping grips 2, 3 are pressed together by the hand of a user, the second crimping grip 3, which is the lower one in the figures and is connected to a lower clamping jaw 6 in a rotary support 13, is pivoted upward. At this time a lever mechanism formed from a thrust strut 15, the second crimping grip 3, and the clamping jaw 6 are stretched so that the clamping jaw 6 is pivoted about a rotary support 4. At this time the crimping mouth of the crimping head 5 of the crimping tool 1 closes.

Figure 2:
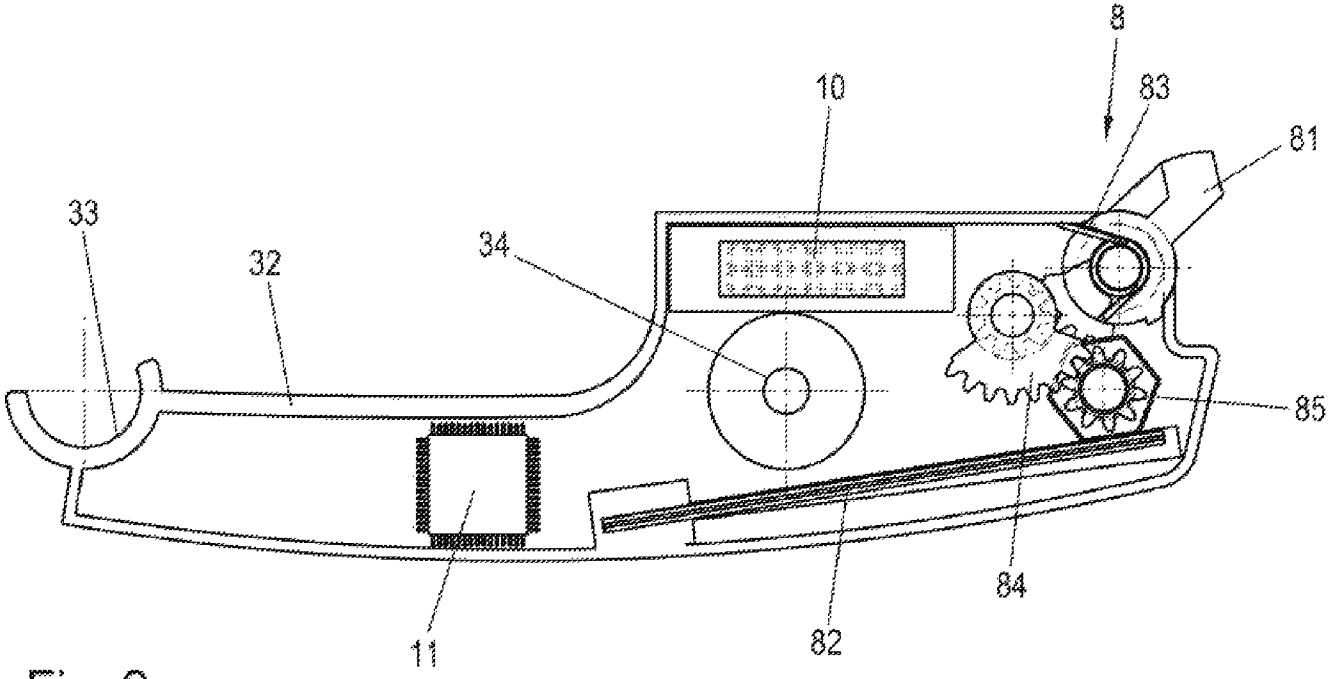
FIG. 2 is a schematic top view of a hand lever of the crimping tool of FIG. 1 with the counter secured therein.

As shown in FIG. 2, an electronic counter 7 is secured in the lower crimping grip 3. The counter 7 includes an electronic circuit 11, preferably constructed as a microprocessor or containing a microprocessor and a signaling device 8 electrically connected with the electronic circuit 11.

In the embodiment shown in FIG. 2, this signaling device 8 includes a tilting lever 81 which is coupled to a polyhedron 85 via a return spring 83 and a translation element 84, for example in the form of one or more intermeshing gears or gear crowns. The polyhedron 85 is constructed as a hexagon in the preferred embodiment shown in FIG. 2.

This polyhedron 85 is rotated through an angle into its closed position by pressing the tilting lever 81 down by moving the crimping grips 2, 3, during which it presses a piezo element 82.

The piezo element 82 is positioned in the crimping grip 3 in such a manner that it is aligned parallel to the axis of rotation of the polyhedron 85. If the polyhedron 85 presses on the piezo element 82, this leads to a change of the shape of the piezo element 82 causing it to generate an electrical voltage.

The electrical energy converted in this manner by the piezo element 82 serves to operate the electronic circuit 11 such as a microprocessor, wherein the electronic circuit 11 receives the activation of the piezo element 82 as a signal to either continue or initiate a counting procedure.

The energy generated by the piezo element 82 is furthermore used to supply a display element 10 which is connected to the electronic circuit 11 and by which an operating display of the crimping tool 1 is output for the user.

The display element 10 can be designed by way of example in the form of a red and a green LED, wherein the green LED, for example, lights up as long as a performed actuation process such as a crimping operation or insulating removal process is present within a previously set border value which is within the service life of the crimping tool 1.

As soon as this service life limit or limit value has been reached, a red LED lights up instead of the green LED, which indicates to the user that the crimping tool 1 was loaded beyond its service life by the just performed activation process.

In an alternative embodiment, the display allows the display of a number, letter or other character which displays, for example, the number of the activation processes carried out or indicates as a word display or character display that the previous total activation number carried out is within the service life limit or exceeds it.

The crimping grips are preferably designed so that they include a hand lever 22, 32 and a grip shell 21, 31 which at least partially surrounds the hand lever 22, 32. The counter 7 is preferably secured in the hand lever 22, 32, in particular in a hollow space of the hand lever 22, 32.

Figure 3:
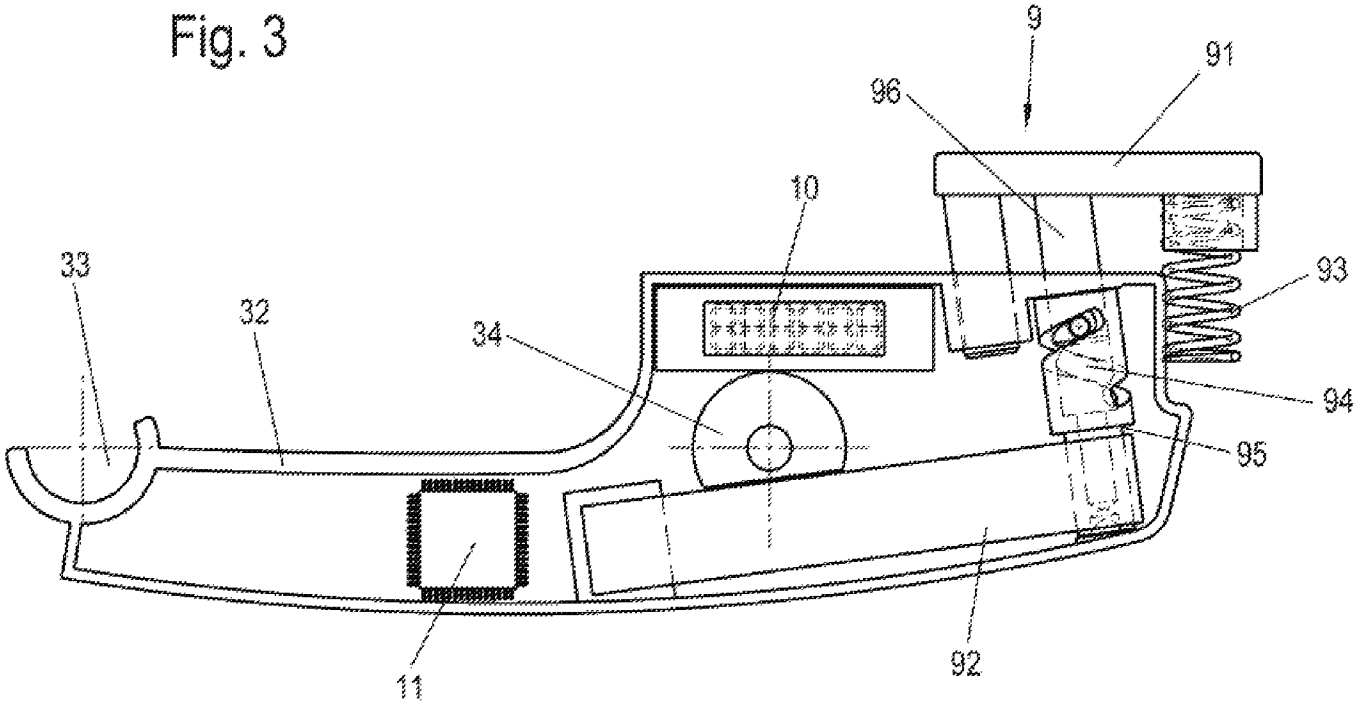
FIG. 3 is a schematic top view of a hand lever of an alternative embodiment of a crimping tool with an activator unit containing a pressure switch.

In the embodiment of the crimping tool 1 shown in FIG. 3, the activator unit 9 is constructed as a pressure switch movably supported in a linear manner on the first one of the crimping grips 3, wherein a pressure element 96 of the pressure switch 91 exerts a mechanical force on the piezo element 92 in the closed position of the crimping grips 2, 3. This embodiment is characterized in that the pressure switch 91 is less complex than the embodiment described above using a tilting lever 81 and translation element 85.

The pressure switch 91 is supported on the lower crimping grip 3 by a return spring 93 and is connected by a translation element 94 to a polyhedron 95 preferably constructed as a hexagon.

The piezo element 92 is inserted vertically relative to the direction of movement of the crimping grips 2, 3 in the hand lever 32. Accordingly, the polyhedron 95 is supported in the hand lever 32 in such a manner that the axis of rotation of the polyhedron is a line parallel to the piezo element 92.

The hand lever 32 includes receptacles 33, 34 for receiving the grip shell 31 in a snap-fit connection.

Figure 4:
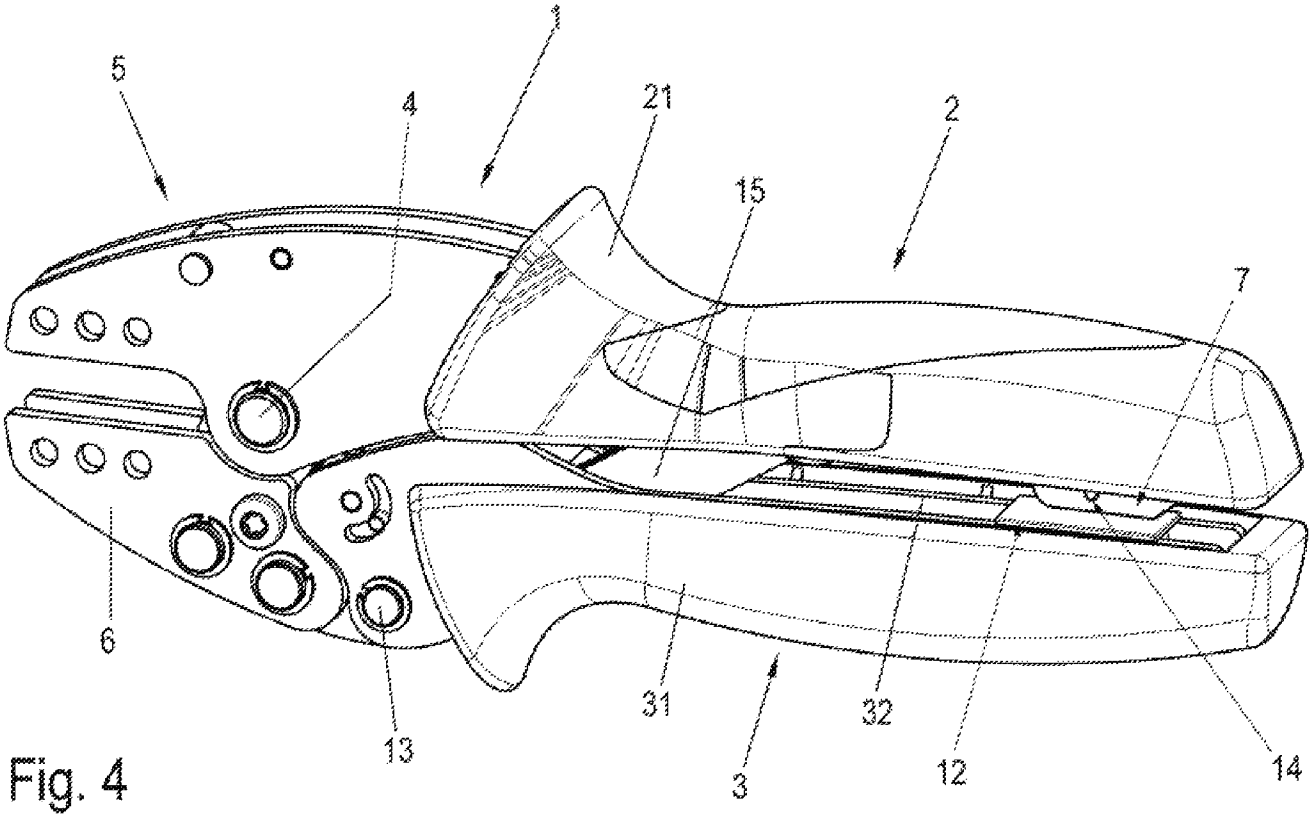
FIG. 4 is a perspective view of another embodiment of a crimping tool with a signaling device including a magnet-sensitive electric switch.
Figure 5:
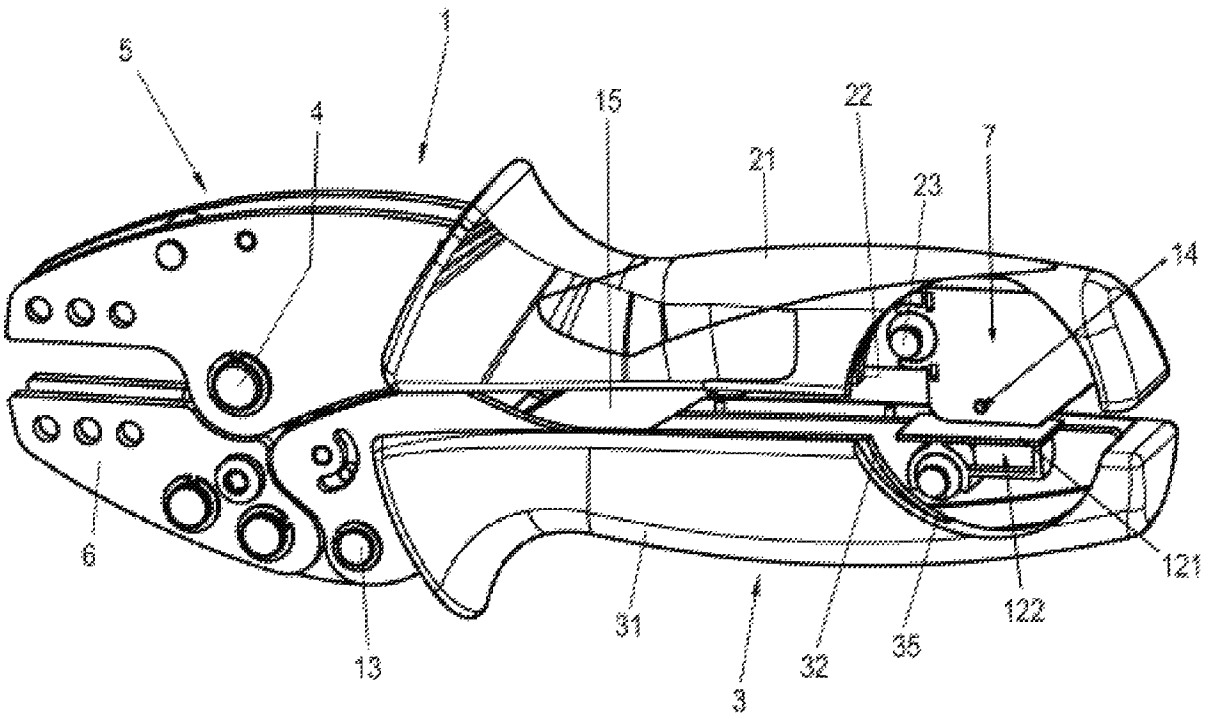
FIG. 5 is a perspective view with partially exploded crimping grips illustrating the counter and a magnet serving as activator.
Figure 6:
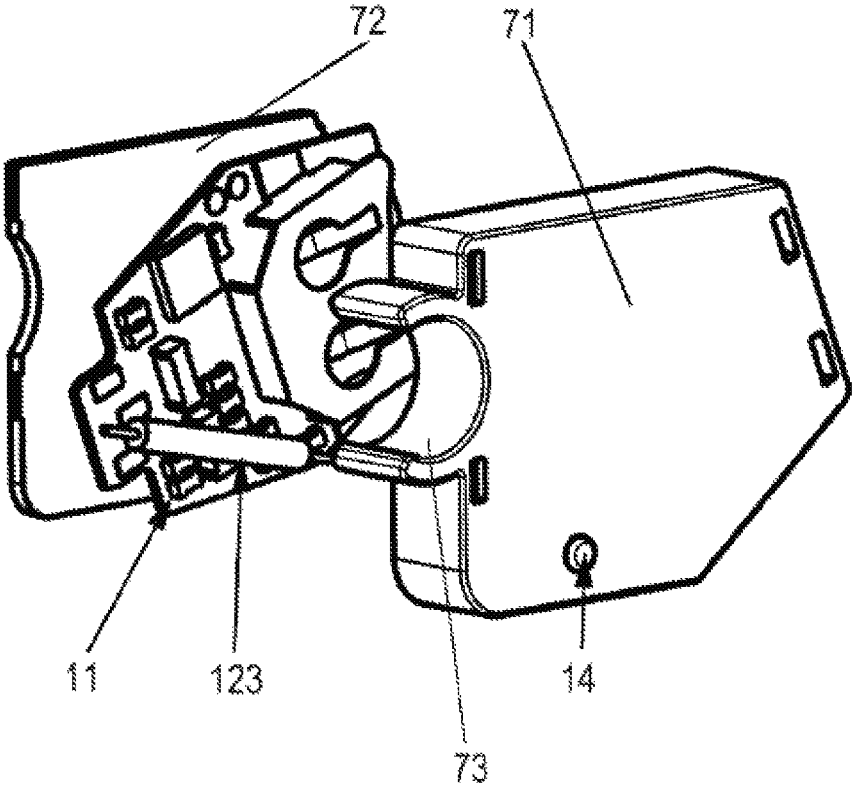
FIG. 6 is a perspective view of the counter built into the crimping tool shown in FIG. 5.

In the embodiment of the crimping tool 1 shown in the FIGS. 4 to 6, the signaling device 12 includes an electromagnetic or magnet-sensitive electrical switch 123 which is secured in the upper one of the crimping grips 2, 3 as shown in FIG. 6.

This switch is activated by a magnet 122 in a magnet holder 121 in the other grip, here the lower one of the crimping grips 2, 3. The magnet moves into the detection range of the electrical switch 123 upon the closing of the crimping tool 1, that is, in the closed position of the crimping grips 2, 3. An electronic contact in the magnet-sensitive electrical switch 123 closes during the approach of the magnet 122. The contact is registered in the electronic circuit 11 and is also preferably stored as a counting event.

The electronic circuit 11 preferably also includes an interface by which the number of activations can be read.

Furthermore, as is shown in FIGS. 5 and 6, the counter 7 in this embodiment includes a housing with two housing covers 71, 72 in which the magnet-sensitive electronic switch 123, the electronic circuit 11 and the display element 14 are arranged.

The display element 14 is constructed as an LED in the embodiment shown in FIGS. 4 to 6. The LED is illuminated when a performed activation process, for example a crimping or insulating removal process, is present beyond a previously set limit value which is within the service life of the crimping tool 1. Other embodiments of display elements are also possible, including for example a display or the like as described above.

The counter 7 is fastened in the hand lever 22 of the upper crimping grip 2 and of the magnet holder 121 in the hand lever 32 of the lower crimping grip 3 by webs 23, 35 which are arranged on the hand levers 22, 32 and are surrounded by a housing portion 73 of the counter 7 or of the magnet holder 121.

While the preferred forms and embodiments of the invention have been illustrated and described, it will be apparent to those of ordinary skill in the art that various changes and modifications may be made without deviating from the inventive concepts set forth above.

The invention claimed is:

1. A hand-actuated crimping tool for electrical cables, comprising (a) first and second crimping grips which are connected for pivotal movement between open and closed positions, one end of each of said grips cooperating to define a crimping head for gripping the cable;

(b) a counter connected with said first crimping grip and including (1) an electronic circuit; and (2) a signaling device connected with said electronic circuit and operable by said second crimping grip each time said crimping grips are in the closed position to emit a counting signal to said electronic circuit, said signaling device comprising a piezo element electrically connected with said electronic circuit and an activator which is displaced by said second crimping grip to create a mechanical force on said piezo element.

2. A crimping tool as defined in claim 1, wherein at least said first crimping grip includes a hand lever and a shell which at least partially surrounds said hand lever.

3. A crimping tool as defined in claim 2, wherein said first crimping grip hand lever contains a recess within which said counter is secured.

4. A crimping tool as defined in claim 1, wherein said activator comprises a lever pivotally supported on said first crimping grip to exert said mechanical force on said piezo element when said crimping grips are in the closed position.

5. A crimping tool as defined in claim 4, and further comprising a translation element coupled with said lever and with a polygon element, said polygon element exerting a mechanical force on said piezo element when said crimping grips are in the closed position.

6. A crimping tool as defined in claim 1, wherein said activator comprises a pressure switch mounted on said first crimping grip, said pressure switch including a pressure element which exerts said mechanical force on said piezo element when said crimping grips are in the closed position.

7. A crimping tool as defined in claim 1, wherein said signaling device includes an electromagnetic switch connected with said first crimping grip and a magnet connected with said second crimping grip, said magnet activating said electromagnetic switch when said crimping grips are in the closed position.

8. A crimping tool as defined in claim 1, wherein said electronic circuit includes at least one display element.

9. A crimping tool as defined in claim 1, wherein said electronic circuit adds the counting signals for comparison with a set number of counting signals to produce an output signal as a function of the comparison, thereby to indicate when the crimping tool has reached a limit of its use.

10. A crimping tool as defined in claim 1, wherein said tool is configured as at least one of crimping pliers and an electrical conductor insulation removal tool.

* * * * *